US007285084B2

(12) United States Patent
Fujimoto et al.

(10) Patent No.: US 7,285,084 B2
(45) Date of Patent: Oct. 23, 2007

(54) FOLDED BACK PORTION FLATTENING DEVICE, SHEET PROCESSOR, AND IMAGE FORMING APPARATUS

(75) Inventors: Hitoshi Fujimoto, Abiko (JP); Yusuke Obuchi, Abiko (JP); Daisaku Kamiya, Abiko (JP); Kiyoshi Watanabe, Kashiwa (JP); Tomokazu Nakamura, Matsudo (JP); Kenichi Hayashi, Abiko (JP); Toshimasa Suzuki, Kashiwa (JP); Hideki Kushida, Moriya (JP); Atsuteru Oikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/555,507

(22) Filed: Nov. 1, 2006

(65) Prior Publication Data

US 2007/0060461 A1 Mar. 15, 2007

Related U.S. Application Data

(63) Continuation of application No. 11/065,204, filed on Feb. 24, 2005, now Pat. No. 7,147,598.

(30) Foreign Application Priority Data

Feb. 27, 2004 (JP) ..... 2004-055558
Jan. 6, 2005 (JP) ..... 2005-001626

(51) Int. Cl.
*B31F 1/10* (2006.01)

(52) U.S. Cl. ..... 493/442; 493/406; 493/407; 412/22; 412/30; 270/45; 270/52.18; 270/58.08; 399/407; 399/408

(58) Field of Classification Search ..... 493/442, 493/405, 406, 407; 412/22, 23, 30; 270/52.18, 270/58.08, 58.16; 399/407–408
See application file for complete search history.

(56) References Cited

U.S. PATENT DOCUMENTS

| | | | | |
|---|---|---|---|---|
| 2,066,620 | A | 1/1937 | Grammer | |
| 2,088,904 | A | 8/1937 | Grammer | |
| 6,611,362 | B2 * | 8/2003 | Mandel et al. | 358/474 |
| 6,692,208 | B1 | 2/2004 | Watkiss et al. | |
| 6,717,286 | B2 * | 4/2004 | Tsuchiya et al. | 270/58.07 |
| 6,817,605 | B1 * | 11/2004 | Bohn | 270/37 |
| 2005/0008460 | A1 * | 1/2005 | Watkiss | 412/9 |

* cited by examiner

*Primary Examiner*—Hemant M. Desai
(74) *Attorney, Agent, or Firm*—Canon U.S.A. Inc I.P. Div

(57) ABSTRACT

A folded back portion flattening device includes a gripper and a presser. The gripper grips a sheet bundle formed into a booklet with the folded back portion protruding from the gripper. The presser presses the folded back portion of the sheet bundle gripped by the gripper, and includes pressing rollers which have pressing rotational surfaces and which are disposed along the folded back portion. The pressing rotational surfaces press the folded back portion. The pressing rollers are disposed so that the rotational pressing surface of a second pressing roller, which presses the folded back portion after the rotational pressing surface of a first pressing roller has pressed the folded back portion, presses deeper into an edge of the sheet bundle than the rotational pressing surface of the first pressing roller. At least one of the gripper and presser is movable in a direction parallel to the folded back portion.

10 Claims, 17 Drawing Sheets

G:DIFFERENCE IN POSITION

FOLDED BACK PORTION FLATTENING DEVICE, SHEET PROCESSOR, AND IMAGE FORMING APPARATUS

CROSS-REFERENCE TO RELATED APPLICATIONS

This application is a continuation of U.S. patent application Ser. No. 11/065,204 filed Feb. 24, 2005, now U.S. Pat. No. 7,147,598 issued on Dec. 12, 2006, which is related to U.S. patent application Ser. No. 11/066,131 filed Feb. 24, 2005 and to U.S. patent application Ser. No. 11/065,325 filed Feb. 24, 2005, all of which are incorporated by reference herein in their entirety.

BACKGROUND OF THE INVENTION

1. Field of the Invention

The present invention relates to a folded back portion flattening device which flattens a folded back portion of a bundle of sheets, a sheet processor incorporating the folded back portion flattening device, and an image forming apparatus. More particularly, the present invention relates to a folded back portion flattening device capable of reducing a load that is produced when a pressing roller starts pressing a folded back portion of a bundle of sheets, a sheet processor, and an image forming apparatus.

2. Description of the Related Art

Hitherto, a predetermined number of not more than 20 sheets have been folded and formed into a booklet with a stitching/folding machine. The sheets folded with the stitching/folding machine may be, for example, sheets that are simply folded, or sheets that are folded after being saddle bound, or sheets that are folded after being bound together with an adhesive rather than thread or staples (that is, after being subjected to perfect binding).

Regardless of whether the bundle of sheets is simply folded or is folded after being bound, since the bundle of sheets is slightly resilient, portions near the folded back portion (top portion of the fold or spine) of the folded bundle of sheets bulge and become curved in a U shape. As a result, the open side of the folded sheets tends to widen. When such folded sheet bundles are stacked, they become unstable. Therefore, they tend to fall apart, as a result of which they cannot be easily conveyed or stored when stacked.

In order to overcome the aforementioned problems, a folded back portion flattening device which flattens a folded back portion of a bundle of sheets so that the sheet bundle can be placed flat on a surface is disclosed in U.S. Pat. No. 6,692,208.

A known folded back portion flattening device is shown in FIGS. 15 and 16. In a folded back portion flattening device 901, a saddle-bound sheet bundle S which is folded in two and formed into a booklet after being discharged in the direction of arrow B from a pair of folding rollers 907 with a folded back portion (spine) Sb as a leading end is temporarily received and stopped by a stopping plate 905 that can be raised and lowered (see FIG. 16A). Then, in the flattening device 901, the sheet bundle is gripped by grippers 902 and 903, and the stopping plate 905 is raised (see FIG. 16B). At this time, the folded back portion Sb protrudes from the grippers 902 and 903. The stopping plate 905 moves away from the folded back portion Sb. Thereafter, in the flattening device 901, a pressing roller 904 of a pressing unit presses the folded back portion Sb, and moves in the direction of arrow A and parallel with the folded back portion Sb. The curved folded back portion Sb is flattened by being pressed by the pressing roller 904. Lastly, in the flattening device 901, the processed sheet bundle S is loaded onto a sheet-discharge tray 908 by being discharged into the sheet-discharge tray 908 in the direction of arrow B by a pair of discharge belts 906 (see FIG. 16C).

In this way, the known folded back portion flattening device 901 flattens the folded back portion Sb of the sheet bundle S by pressing the folded back portion Sb by a predetermined amount with the pressing roller 904.

As shown in FIG. 17, the known folded back portion flattening device 901 is incorporated in a sheet processor 920 which folds a bundle of sheets. The sheet processor 920 is connected to a body 922 of an image forming apparatus 921. The image forming apparatus 921 forms images on the sheets.

In the known folded back portion flattening device 901, the folded back portion Sb of the sheet bundle is flattened by one pressing roller, that is, the pressing roller 904. Therefore, if the sheet bundle is thick or if a material that cannot be easily flattened is used when the sheet bundle is not thick, when an attempt is made to press the folded back portion Sb by a predetermined amount that is the same as that when a thin sheet bundle is pressed, a load that is produced when the pressing roller 904 starts pressing the folded back portion Sb is large. Consequently, it is difficult to flatten the folded back portion Sb.

When a sheet bundle having a folded back portion that cannot be easily flattened is flattened because the load that is produced when the pressing roller 904 starts pressing the folded back portion Sb is large, it is necessary to reduce the speed of movement of the pressing roller 904 or to repeatedly carry out the flattening with a small pressing force. Therefore, sheet processing efficiency is poor. In addition, it is necessary to convey bundles of sheets to the flattening device at an interval that is larger than necessary, thereby resulting in poor sheet processing efficiency.

Further, in the image forming apparatus having the sheet processor having a poor sheet processing efficiency, it is necessary to convey sheets to the sheet processor at an interval that is larger than necessary, thereby resulting in poor image formation efficiency.

SUMMARY OF THE INVENTION

The present invention is directed to a folded back portion flattening device which can reduce a load that is produced when a pressing member starts to press a folded back portion of a sheet bundle in a pressing unit which flattens the folded back portion of the sheet bundle.

The present invention is also directed to a sheet processor which provides increased sheet processing efficiency as a result of incorporating the folded back portion flattening device which can reduce a load that is produced when the pressing member of the pressing unit starts to press a folded back portion of a sheet bundle.

The present invention is further directed to an image forming apparatus which provides increased image formation efficiency as a result of incorporating the sheet processor which provides increased sheet processing efficiency.

In one aspect of the present invention, there is provided a folded back portion flattening device operable to flatten a folded back portion of a sheet bundle. The flattening device includes a gripping unit configured to the sheet bundle such that the folded back portion of the sheet bundle protrudes from the gripping unit, and a pressing unit configured to press the folded back portion of the sheet bundle gripped by the gripping unit. At least one of the gripping unit and the pressing unit is movable in a direction parallel to the folded back portion. The pressing unit includes a plurality of pressing members disposed along the folded back portion, including at least first and second pressing members arranged such that the first pressing member presses the folded back portion prior to the second pressing member pressing the folded back portion. Each of the pressing members has a pressing surface adapted to press the folded back portion. The pressing surface of the second pressing member presses deeper into the folded back portion than the pressing surface of the first pressing member pressing into the folded back portion.

In another aspect of the present invention, a sheet processor operable to process sheets includes a folding unit configured to bundle sheets and to fold the sheet bundle, and the folded back portion flattening device described above.

In yet another aspect of the present invention, an image forming apparatus operable to form images on sheets includes an image forming unit configured to form images on sheets, a folding unit configured to bundle the sheets having the images formed thereon by the image forming unit and to fold the sheet bundle, and the flattening device described above.

Since the folded back portion flattening device of the present invention includes a plurality of pressing members so that the pressing surface of the second pressing member, which presses the folded back portion after the pressing surface of the first pressing member has pressed the folded back portion, presses deeper into an edge of the sheet bundle than the pressing surface of the first pressing member, the folded back portion can be gradually pressed successively by the pressing members. Therefore, the load that is produced when any pressing member starts pressing the folded back portion is reduced, so that the folded back portion is easily flattened.

The sheet processor of the present invention includes the folded back portion flattening device which can easily flatten a folded back portion of a sheet bundle. Therefore, sheet processing efficiency is increased. In addition, sheet bundles are conveyed to the folded back portion flattening device at an interval that is not larger than necessary, thereby resulting in increased sheet processing efficiency.

The image forming apparatus of the present invention includes the sheet processor having increased sheet processing efficiency. Therefore, sheet bundles can be conveyed to the sheet processor at an interval that is not larger than necessary, thereby resulting in increased image formation efficiency.

Further features and advantages of the present invention will become apparent from the following description of exemplary embodiments with reference to the attached drawings.

BRIEF DESCRIPTION OF THE DRAWINGS

FIG. 16A shows a state in which a sheet bundle is received and stopped by a stopping plate. FIG. 16B shows a state in which a mold roller is press-contacting a folded back portion of the sheet bundle. FIG. 16C shows a state in which the sheet bundle is discharged.

DESCRIPTION OF THE EMBODIMENTS

Figure 1:
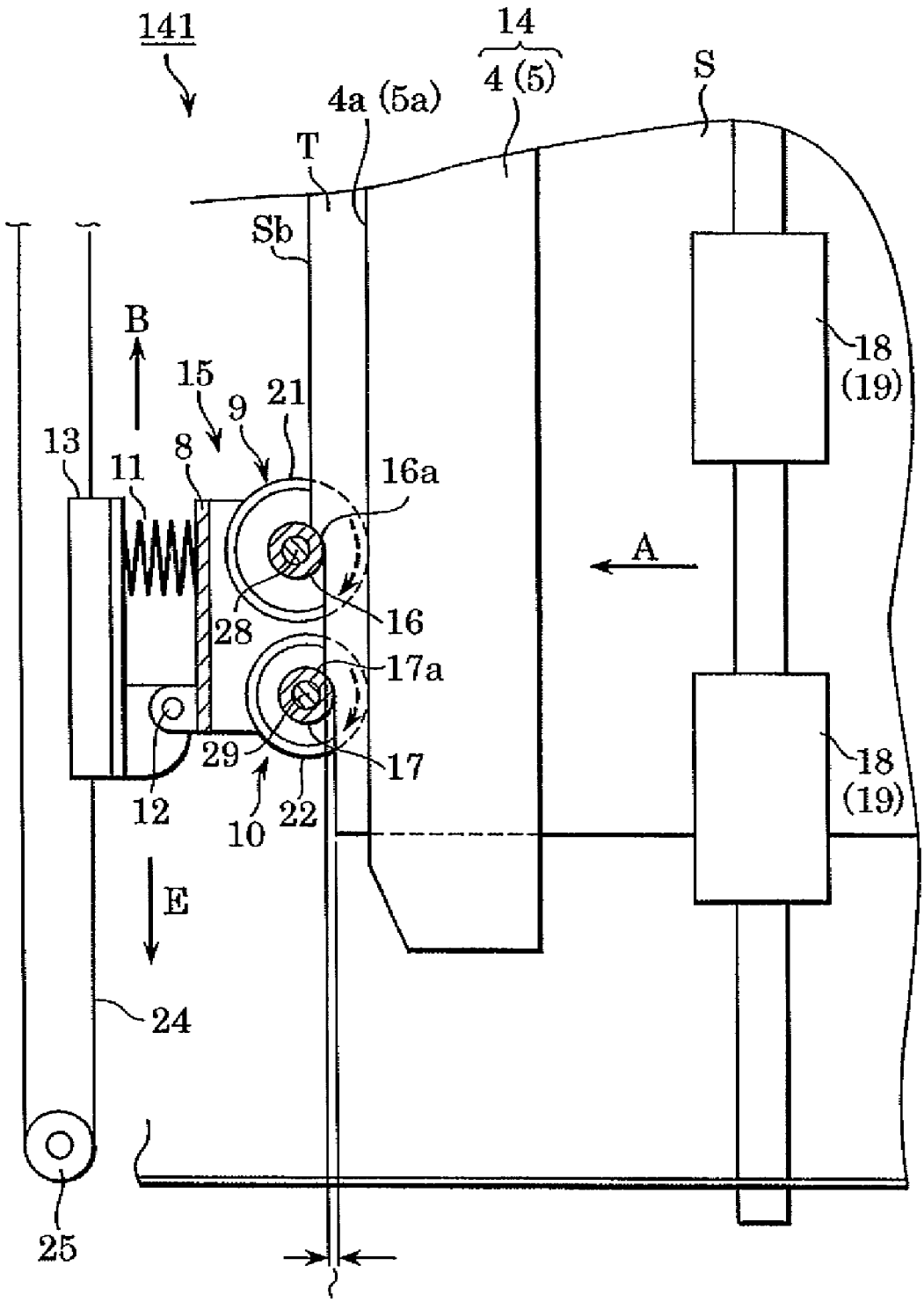
FIG. 1 is plan view of a folded back portion flattening device of a first embodiment of the present invention.

Folded back portion flattening devices of embodiments of the present invention, sheet processors incorporating any one of the flattening devices, and copying machines which are examples of image forming apparatuses will hereunder be described with reference to the relevant drawings.

Copying Machine

Structure of the Copying Machine

The copying machine, which is an example of an image forming apparatus, will be described with reference to FIG. 7. A copying machine 1, such as a full color copying machine, includes a platen glass 71 (serving as an original table), a light source/lens system 72, a sheet feeder 64, a pair of register rollers 76, an image forming unit 65, an automatic original feeder 73 which automatically feeds originals to the platen glass 71, and a sheet processor 2 which includes a folded back portion flattening device in accordance with the present invention and which processes sheets having images formed thereon and discharged from a body 3 of the copying machine 1.

The sheet feeder 64 includes a plurality of cassettes 68 which accommodate record sheets and are removable from the body 3. The image forming unit 65 includes cylindrical photosensitive drums 74 and developing sections 75, disposed near the respective photosensitive drums 74, in accordance with respective colors, that is, yellow, magenta, cyan, and black. A fixing device 66 and a pair of discharge rollers 63 are disposed downstream from the image forming unit 65. The fixing device 66 fixes a color toner image transferred onto a sheet S from the photosensitive drums 74 to the sheet S. The pair of discharge rollers 63 discharges the sheet S.

Operation of the Copying Machine

When a sheet feed signal is output from the body 3 of the copying machine 1, a sheet is fed by the pair of register rollers 76 from any one of the cassettes 68 of the sheet feeder 64. Signal processing is performed via the light source/lens system 72 on light emitted from the light source/lens system 72 and reflected by an original placed on the platen glass 71 by a user. Then, the photosensitive drums 74 are irradiated with the processed light via a write optical system (not shown). The photosensitive drums 74 are previously charged by a primary charger (not shown). Accordingly, when the photosensitive drums 74 are irradiated with the processed light, an electrostatic latent image is formed thereon. The developing sections 75 develop the electrostatic latent image on the photosensitive drums 74 so as to form a color toner image.

Slanting of the sheet fed from the sheet feeder 64 is corrected by the pair of register rollers 76. Then, the sheet is sent to the image forming unit 65 in accordance with a timing at which the sheet is sent to toner image positions of the photosensitive drums 74 in order to transfer the color toner image formed on the photosensitive drums 74. After the transfer of the color toner image, the fixing device 66 permanently fixes the toner image to the sheet. After the fixing of the color toner image, the sheet is discharged from the body 3 by the pair of discharge rollers 63.

Accordingly, the color toner image is formed on the sheet fed from the sheet feeder 64, and the sheet having the color toner image formed thereon is sent to the sheet processor 2 from the body 3.

Sheet Processor

Structure of the Sheet Processor

Figure 7:
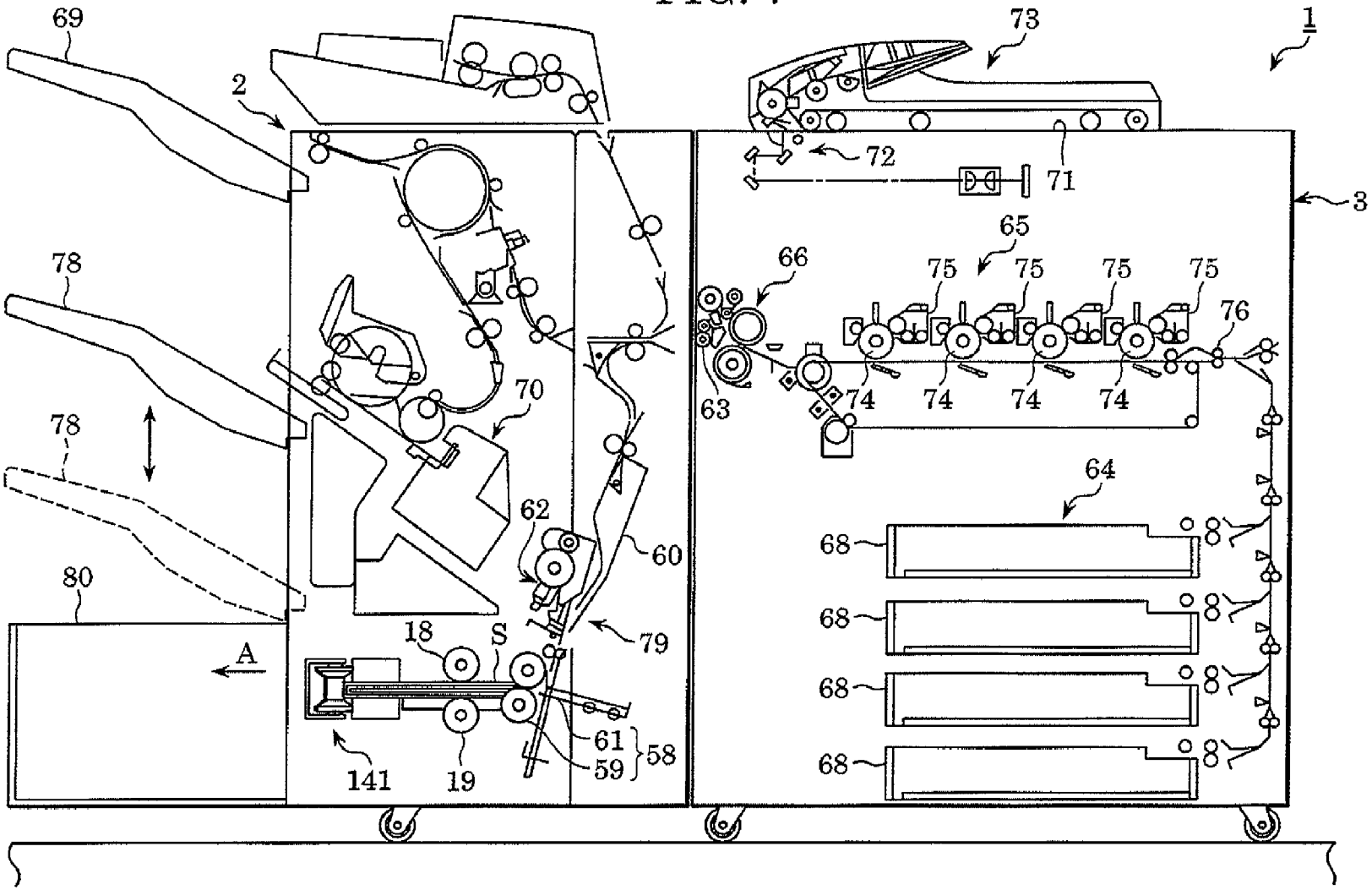
FIG. 7 is a schematic sectional front view of a copying machine incorporating the folded back portion flattening device of the first embodiment.

As shown in FIG. 7, the sheet processor 2 includes a stationary tray 69, a stapler 70, a stack tray 78, a booklet forming unit 79, and a folded back portion flattening device 141 of the first embodiment. The stationary tray 69 is used for loading sheets discharged from the sheet processor 2 after the sheets have been discharged by the pair of discharge rollers 63 at the body 3 of the copying machine 1 and have passed through the sheet processor 2. The stapler 70 performs a binding operation after sheets discharged from the body 3 are bundled. The stack tray 78 serves as a loading unit which can be raised and lowered and which is used for loading the discharged sheet bundle bound by the stapler 70. The booklet forming unit 79 folds the sheet bundle in two and forms a booklet after bundling the sheets discharged from the body 3 and binding the bundle of sheets. The folded back portion flattening device 141 is disposed below the stack tray 78 at its raised position.

The sheet processor 2 may include a folded back portion flattening device 241 of a second embodiment or a folded back portion flattening device 341 of a third embodiment instead of the folded back portion flattening device 141 of the first embodiment. The bundled sheets are sometimes discharged and loaded onto the stack tray 78 without being bound by the stapler 70.

After bundling the sheets discharged from the pair of discharge rollers 63 at the body 3 of the copying machine 1 and binding the center of the sheet bundle by a stapler 62, the booklet forming unit 79 folds the bundle of sheets in two with the bound portion as a center and forms a booklet. The sheet bundle is sometimes only folded in two to form a booklet without binding the sheet bundle by the stapler 62.

Operation of the Sheet Processor

The booklet forming unit 79 successively receives and stops the sheets conveyed from the pair of discharge rollers 63 by a saddle tray 60, and aligns the sheets to form the sheet bundle. The stapler 62 performs saddle binding on the aligned sheet bundle, and a push plate 61 contacts the bound portion and pushes it into a nip portion of a pair of folding rollers 59. The push plate 61 that has pushed the sheet bundle to a location between the pair of folding rollers 59 retreats. The pair of folding rollers 59 folds the sheet bundle in two while gripping and conveying the sheet bundle, and conveys the folded sheet bundle to the folded back portion flattening device 141. The sheet bundle may be folded and conveyed to the folded back portion flattening device 141 without being bound by the stapler 62.

A folding unit 58 includes the push plate 61 and the pair of sheet bundle folding rollers 59. The booklet forming unit 79 includes the stapler 62 and the folding unit 58. Although, in the structure in accordance with the embodiment, the sheet bundle folded with the folding unit 58 is transported to the folded back portion flattening device 141 connected at a location downstream therefrom in the direction of transportation in order to flatten the folded back portion Sb, the invention of the application may be effectively applied to a structure in which the sheet bundle folded with a different folding unit is manually inserted into the folded back portion flattening device 141 in order to flatten the folded back portion.

Folded Back Portion Flattening Device of the First Embodiment

Structure of the Folded Back Portion Flattening Device of the First Embodiment As shown in FIGS. 1 to 7, the folded back portion flattening device 141 (see FIG. 7) flattens a curved U-shaped folded back portion (spine) Sb of a sheet bundle formed into a booklet conveyed from the booklet forming device 79 as a result of gradually pushing first and second pressing rollers 9 and 10 into the folded back portion Sb.

Figure 2:
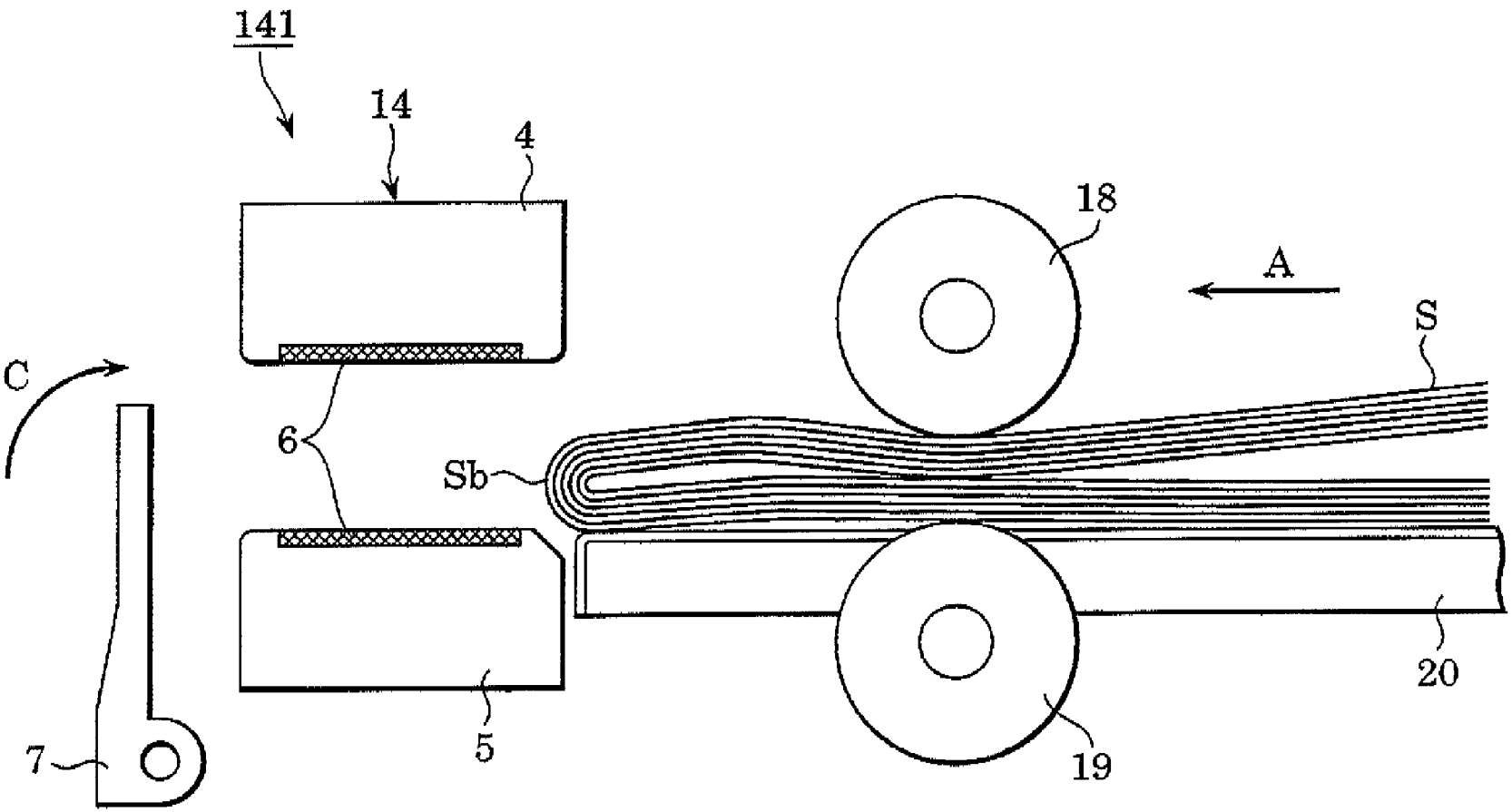
FIG. 2 is a partial front view of the folded back portion flattening device of the first embodiment to which a sheet bundle has been conveyed.
Figure 3:
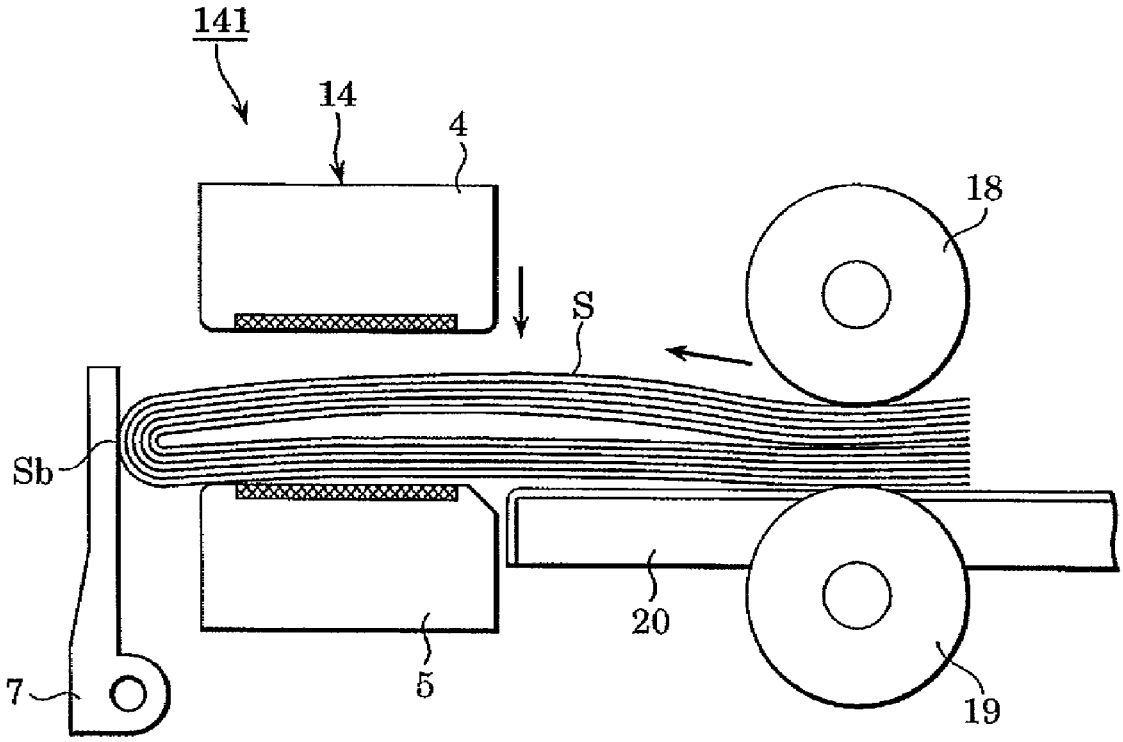
FIG. 3 shows a state in which the sheet bundle contacts an end stopper after the state shown in FIG. 2.

The folded back portion flattening device 141 includes a sheet bundle guide plate 20 (see FIG. 2), pairs of conveying rollers 18 and 19, a gripper 14, a presser 15 (see FIG. 1), and an end stopper 7 (see FIG. 3). The guide plate 20 supports and guides a sheet bundle S conveyed from the pair of folding rollers 59 (see FIG. 7) so that the folded back portion Sb is a leading end of the sheet bundle S. The conveying rollers 18 and 19 convey the sheet bundle S by guiding it along the guide plate 20. The gripper 14 grips the folded sheet bundle. The presser 15 presses and flattens the folded back portion Sb of the sheet bundle S gripped by the gripper 14. The stopper 7 receives and stops the folded back portion Sb of the sheet bundle S conveyed by the conveying rollers 18 and 19 with the folded back portion Sb being the leading end.

In the folded back portion flattening device 141 of the embodiment, the gripper 14 is fixed and stationary, whereas the presser 15 is movable along the folded back portion.

As shown in FIGS. 2 to 5, the gripper 14 includes a stationary gripping plate 5 and a gripping plate 4 which can be raised and lowered. The gripping plate 4 and the stationary gripping plate 5 grip the sheet bundle as a result of the gripping plate 4 approaching the stationary gripping plate 5 by a driving unit (not shown). Resilient sheets 6 formed of, for example, resilient resin, sponge, or rubber are provided on the surfaces of the gripping plates 4 and 5 which contact the sheet bundle in order to prevent the sheet bundle from, for example, being scratched or having gripping marks left on them by the gripping. The gripping plates 4 and 5 are oriented perpendicularly to the direction of conveying the sheet bundle S (that is, the direction of arrow A). The length of the gripping plates 4 and 5 along the folded back portion Sb can be equal to or greater than the width of the sheet bundle (that is, the length of the sheet bundle along the folded back portion Sb).

Figure 5:
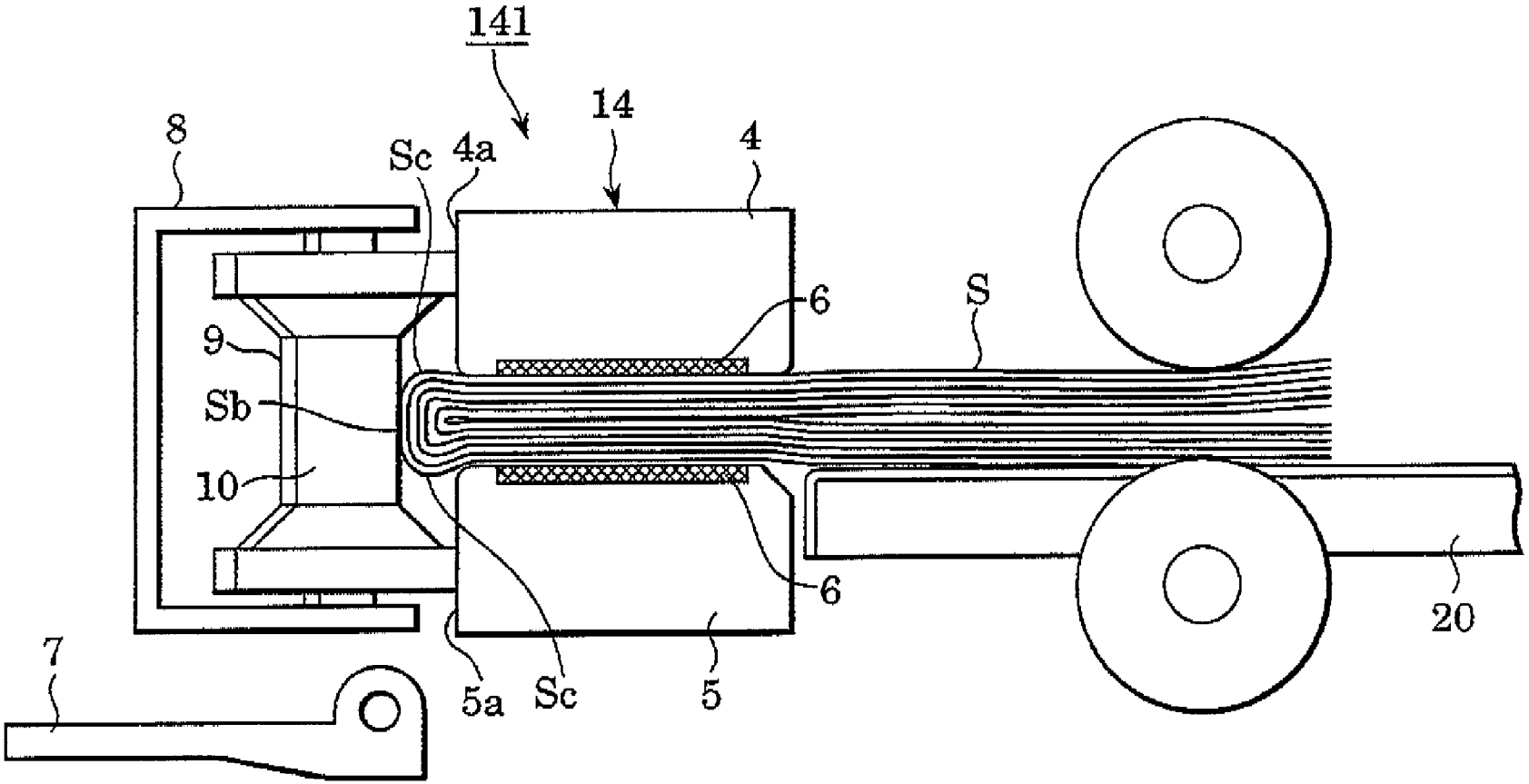
FIG. 5 shows a state in which a folded back portion of the sheet bundle is being flattened by a pressing roller after the state shown in FIG. 4.

Since the gripping plates 4 and 5 having a length that is equal to or greater than the length of the folded back portion Sb grip portions near the folded back portion at both sides of the sheet bundle, even if the folded back portion Sb is pressed by the first pressing roller 9 and the second pressing roller 10 (both of which are described later) as shown in FIG. 5, the folded back portion Sb is not easily dislodged. Therefore, the folded back portion Sb can be easily flattened, and edges Sc of the sheet bundle can be easily angled. In other words, at the gripping plates 4 and 5, the portions near the folded back portion Sb of the sheet bundle are substantially angulated in cross section by the first pressing roller 9 and the second pressing roller 10.

As shown in FIG. 1, the presser 15 includes the first pressing roller 9 and the second pressing roller 10 disposed along the folded back portion Sb. The first pressing roller 9 and the second pressing roller 10 are rotatably disposed at a pressing roller holder 8. One end of the pressing roller holder 8 is rotatably disposed at a movable plate 13 by an equalizer shaft 12, and the other end of the pressing roller holder 8 is pushed towards the gripper 14 by an equalizer spring 11 disposed between the pressing roller holder 8 and the movable plate 13. When flanges 21 and 22 come into contact with the gripping plates 4 and 5 of the gripper 14 and rotate along guide surfaces of the gripping plates 4 and 5, the presser 15 can move while maintaining a stable posture. When the first pressing roller 9 is not in contact with the folded back portion Sb, the pressing roller holder 8 is stopped by a stopper (not shown) in order to prevent it from rotating excessively by being pushed by the equalizer spring 11.

A rotatable toothed belt 24 is connected to the movable plate 13, and is disposed on a toothed drive pulley 25 and a toothed driven pulley (not shown). The drive pulley 25 is rotated by a drive motor (not shown).

When the presser 15 moves in the direction of arrow B while the first pressing roller 9 and the second pressing roller 10 press the folded back portion of the sheet bundle, a load acting in a direction opposite to the direction of arrow E is applied to the first pressing roller 9 and the second pressing roller 10. However, since the belt and the pulleys have toothed portions for engagement, the belt and the pulleys do not slip. Therefore, the presser 15 reliably moves in the direction of arrow B.

Although the pressing roller holder 8 is rotatably disposed at the movable plate 13, the pressing roller holder 8 may be disposed so as to be movable parallel to the folded back portion rather than rotatably disposed. A chain and a sprocket may be used instead of the toothed belt and pulleys.

Figure 6:
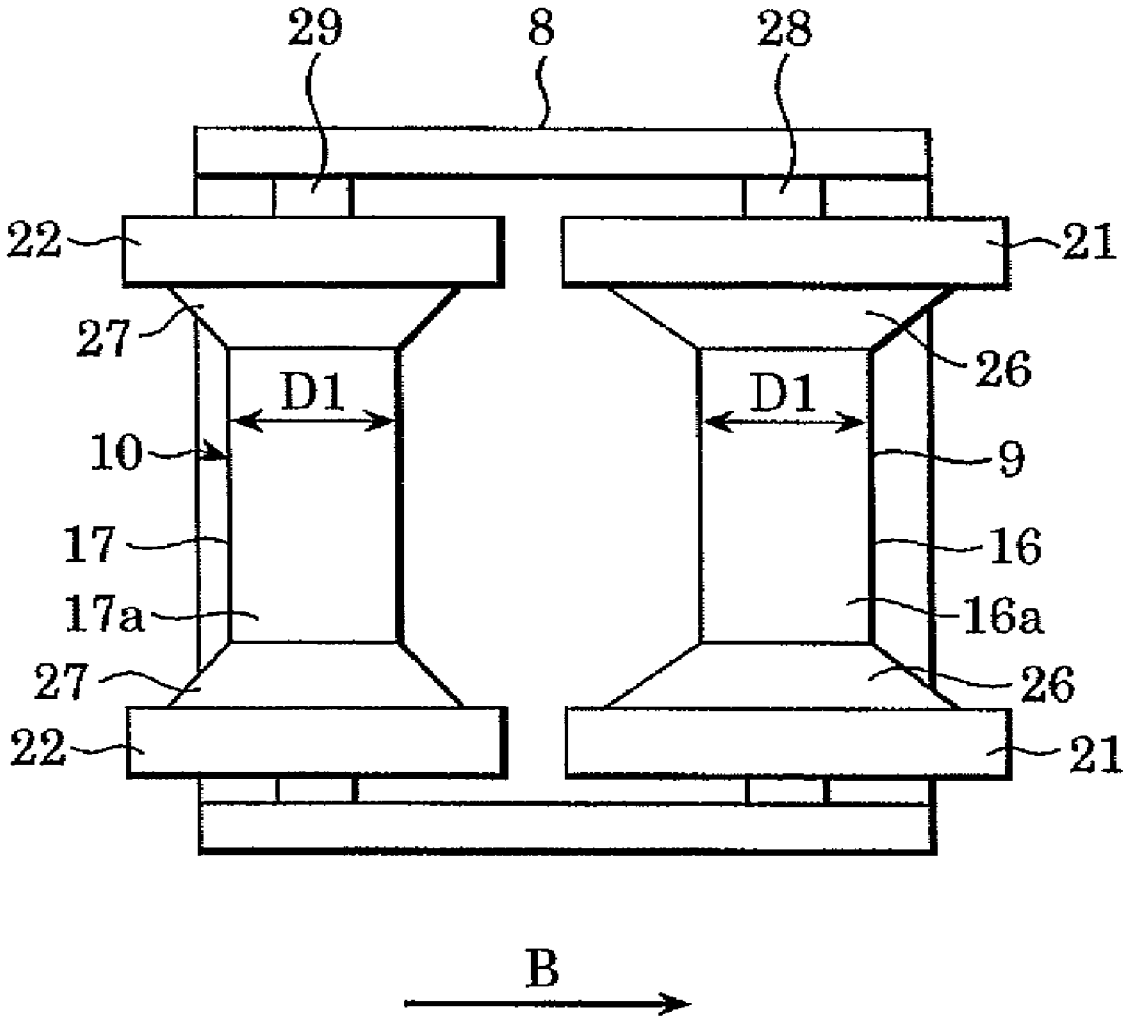
FIG. 6 is a right side view of the pressing rollers shown in FIG. 1.

As shown in FIG. 6, the first pressing roller 9 and the second pressing roller 10 have pressing roller portions 16 and 17, the flanges 21 and 22, conical guide surfaces 26 and 27, and shafts 28 and 29, respectively. The pressing roller portions 16 and 17 have pressing rotational surfaces 16*a* and 17*a* which press the folded back portion Sb, respectively. The flanges 21 and 22 serve as restricting portions. Although the pressing roller portions 16 and 17 and the flanges 21 and 22 having the guide surfaces 26 and 27 formed thereat are integrally formed, they may be separately formed. The guide surfaces 26 and 27 guide the folded back portion Sb towards the pressing rotational surfaces 16*a* and 17*a*.

The first pressing roller 9 and the second pressing roller 10 of the presser 15 having the above-described structure move along the folded back portion Sb of the sheet bundle by the rotation of the toothed belt 24, and gradually press and flatten the curved U-shaped folded back portion Sb of the sheet bundle folded in two and formed into a booklet (see FIG. 1).

The pressing rotational surface 17*a* of the second pressing roller 10, which presses the folded back portion Sb after the pressing rotational surface 16*a* of the first pressing roller 9 has pressed the folded back portion Sb, presses deeper into an edge of the sheet bundle. More specifically, the pressing roller portions 16 and 17 having the pressing rotational surfaces 16*a* and 17*a* have the same diameter (D1, see FIG. 6), and the radius of each flange 21 is greater than that of each flange 22 by a distance G. Accordingly, the second pressing roller 10 which presses the folded back portion Sb as a result of rotating and moving the flanges 22 along the gripping plates 4 and 5 after the first pressing roller 9 has pressed the folded back portion Sb as a result of rotating and moving the flanges 21 along the gripping plates 4 and 5 presses deeper into the edge of the sheet bundle by the distance G (see FIG. 1). Therefore, the first pressing roller 9 and the second pressing roller 10 move along the folded back portion Sb of the sheet bundle by the rotation of the toothed belt 24, and gradually press and flatten the curved U-shaped folded back portion Sb of the sheet bundle folded in two and formed into a booklet.

Spring pressure of the equalizer spring 11 is set in relation to the protruding amount of the folded back portion Sb so that the flanges 21 of the first pressing roller 9 rotate and move along guide surfaces 4*a* and 5*a* of the gripping plates 4 and 5. If the spring pressure becomes greater than the set value and the sheet bundle is thick or a material of a type that cannot be easily flattened is used, the first pressing roller 9 receives an opposing force from the folded back portion Sb, thereby flexing the equalizer spring 11. This causes the flanges 21 to move away from the guide surfaces 4*a* and 5*a* of the gripping plates 4 and 5. This structure makes it possible to prevent damage to the sheet bundle.

In contrast, if the spring pressure becomes greater than the set value and the sheet bundle is thin or a material of a type that tends to be damaged is used, the guide surfaces 4*a* and 5*a* of the gripping plates 4 and 5 serve as stoppers for preventing damage to the sheet bundle.

Operation of the Folded Back Portion Flattening Device of the First Embodiment As shown in FIGS. 1 and 2, the conveying rollers 18 and 19 convey the sheet bundle in the direction of arrow A so that the folded back portion Sb (that is the top portion of the fold) of the sheet bundle S folded in two by the folding rollers 59 (see FIG. 7) is the leading end. As shown in FIGS. 2 and 3, the folded back portion Sb of the sheet bundle S is brought into contact with the end stopper 7 that has been rotated in the direction of arrow C to its upright position, is set so that its slanting orientation is corrected, and is positioned. At this time, as shown in FIG. 3, the sheet bundle S is disposed between the separated pair of gripping plates 4 and 5.

In order to fix the sheet bundle S in contact with and stopped by the end stopper 7, the gripping plate 4 is lowered. The gripping plates 4 and 5 grip the portions near the folded back portion Sb at both sides of the sheet bundle S. Although the upper gripping plate 4 and the lower stationary gripping plate 5 grip the sheet bundle as a result of lowering the upper gripping plate 4, the gripping may be achieved by rotating the upper gripping plate 4.

Figure 4:
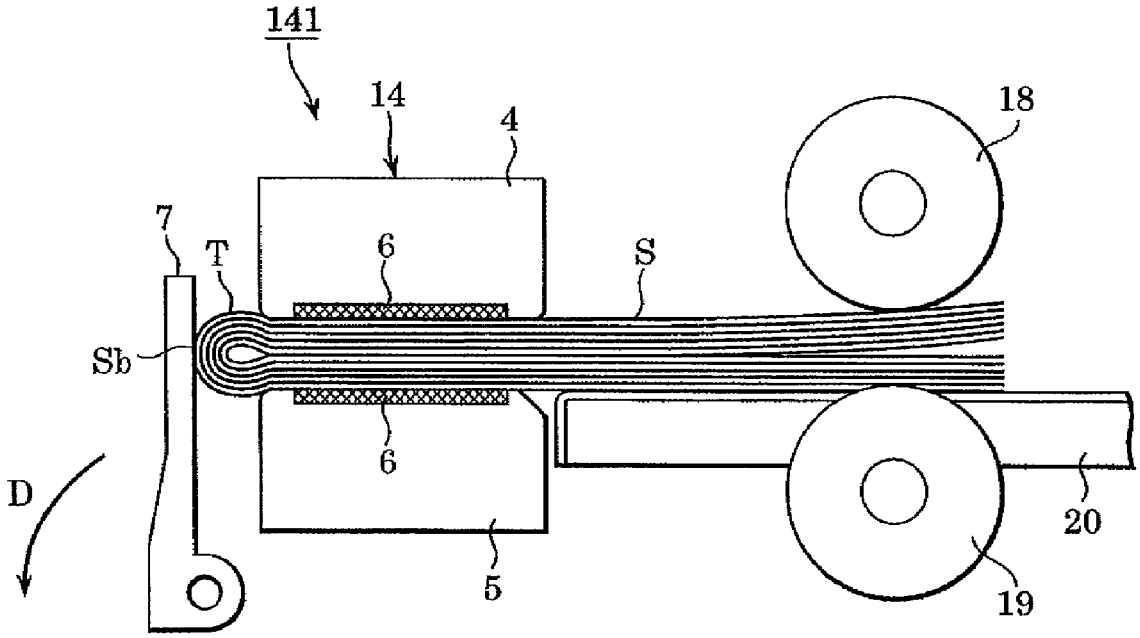
FIG. 4 shows a state in which the sheet bundle is gripped by a pair of gripping plates after the state shown in FIG. 3.

As shown in FIGS. 4 and 5, when the end stopper 7 rotates in the direction of arrow D and separates from the folded back portion Sb after the sheet bundle has been gripped by the gripping plates 4 and 5, a protrusion T (see FIG. 1) is formed in the sheet bundle S. The length of the protrusion T is substantially equal to the length of a space between the upright end stopper 7 and the pair of gripping plates 4 and 5 as shown in FIG. 4. The distance between the pair of gripping plates 4 and 5 and the pressing rotational surface 16*a* of the first pressing roller 9 and the pressing rotational surface 17*a* of the second pressing roller 10 is smaller than the length of the protrusion T. This distance is sufficient to flatten the folded back portion Sb, and provides an optimal pressing force that does not damage the folded back portion Sb.

Thereafter, the presser 15 moves in the direction of arrow B shown in FIG. 1 along the folded back portion Sb of the sheet bundle (that is, from front to back in the plane of FIG. 5) by the rotation of the toothed belt 24. When the flanges 21 and 22 rotate and move along the guide surfaces 4*a* and 5*a* of the pair of gripping plates 4 and 5 so that the presser 15 moves along the folded back portion Sb of the sheet bundle, the first pressing roller 9 and the second pressing roller 10 also move in the same direction. Since the pressing rotational surface 17*a* of the second pressing roller 10 which presses the folded back portion Sb of the protrusion T after the pressing rotational surface 16*a* of the first pressing roller 9 has pressed the folded back portion Sb presses deeper into the edge of the sheet bundle than the pressing rotational surface 16*a* by the distance G, the pressing rotational surfaces 16*a* and 17*a* move while gradually pressing into and flattening the folded back portion Sb. Either the guide surface 4*a* or the guide surface 5*a* may only be formed. However, when both the guide surfaces 4*a* and 5*a* are formed, the folded back portion can be easily flattened without tilting of the first pressing roller 9 and the second pressing roller 10.

Although, in the embodiment, by rotating and moving the flanges 21 and 22 along the guide surfaces 4*a* and 5*a* of the gripping plates 4 and 5, the folded back portion Sb is pressed while the pressing rotational surface 17*a* which presses the folded back portion Sb after the pressing rotational surface 16*a* has pressed the folded back portion Sb presses deeper into the edge of the sheet bundle than the pressing rotational surface 16*a*, all that is necessary is for the pressing rotational surface 17*a* to press the folded back portion Sb at a location that allows it to press deeper into the edge of the sheet bundle than where the pressing rotational surface 16*a* presses the folded back portion Sb. Therefore, the positioning of the pressing rotational surface 16*a* and the pressing rotational surface 17*a* may be reversed in a range not including the folded back portion Sb of the sheet bundle (that is, not including the guide surfaces 4*a* and 5*a*). Alternatively, it is possible to construct the first and second pressing rollers 9 and 10 so that they can reciprocate, and to change the pressing positions of the first and second pressing rollers 9 and 10 by their directions of movement.

The guide surfaces 4*a* and 5*a* do not necessarily have to be disposed. All that is necessary is for a pressing location of the pressing rotational surface 17*a* where an opposing force of the folded back portion Sb and the pressing force of the pressing rotational surface 17*a* balance when pressing the folded back portion Sb is situated so as to allow deeper pressing into the edge of the sheet bundle than at a pressing location of the pressing rotational surface 16*a* where an opposing force of the folded back portion Sb and the pressing force of the pressing rotational surface 16*a* balance when pressing the folded back portion Sb.

The presser 15 which has flattened the folded back portion moves in the direction of arrow E and returns to its waiting position. The pairs of conveying rollers 18 and 19 and the discharge rollers (not shown), disposed downstream from the pair of conveying rollers 18 and 19, convey the sheet bundle whose folded back portion has been flattened in the direction of arrow A and discharge the sheet bundle into a sheet-discharge tray 80 (see FIG. 7).

Figure 13:
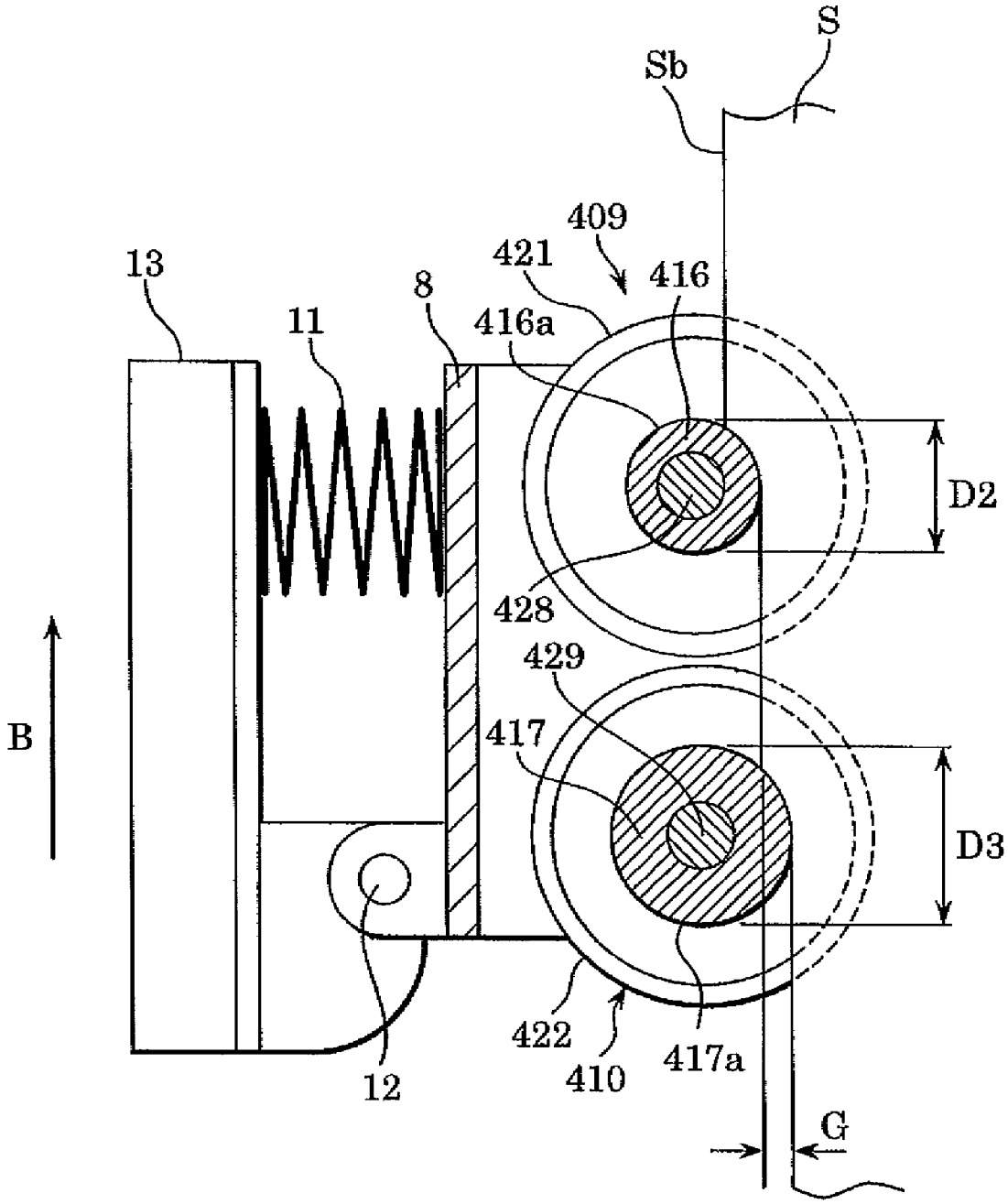
FIG. 13 is a plan view of another example of pressing rollers.
Figure 14:
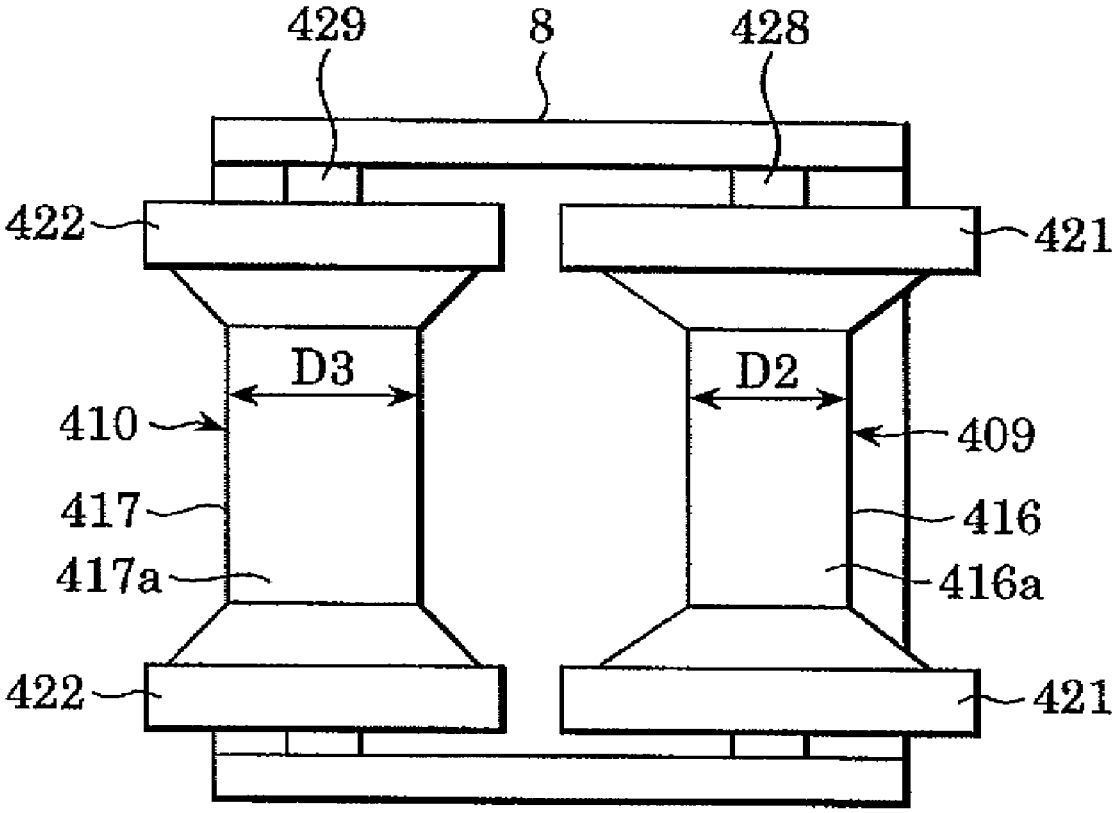
FIG. 14 is a right side view of the pressing rollers shown in FIG. 13.
Figure 15:
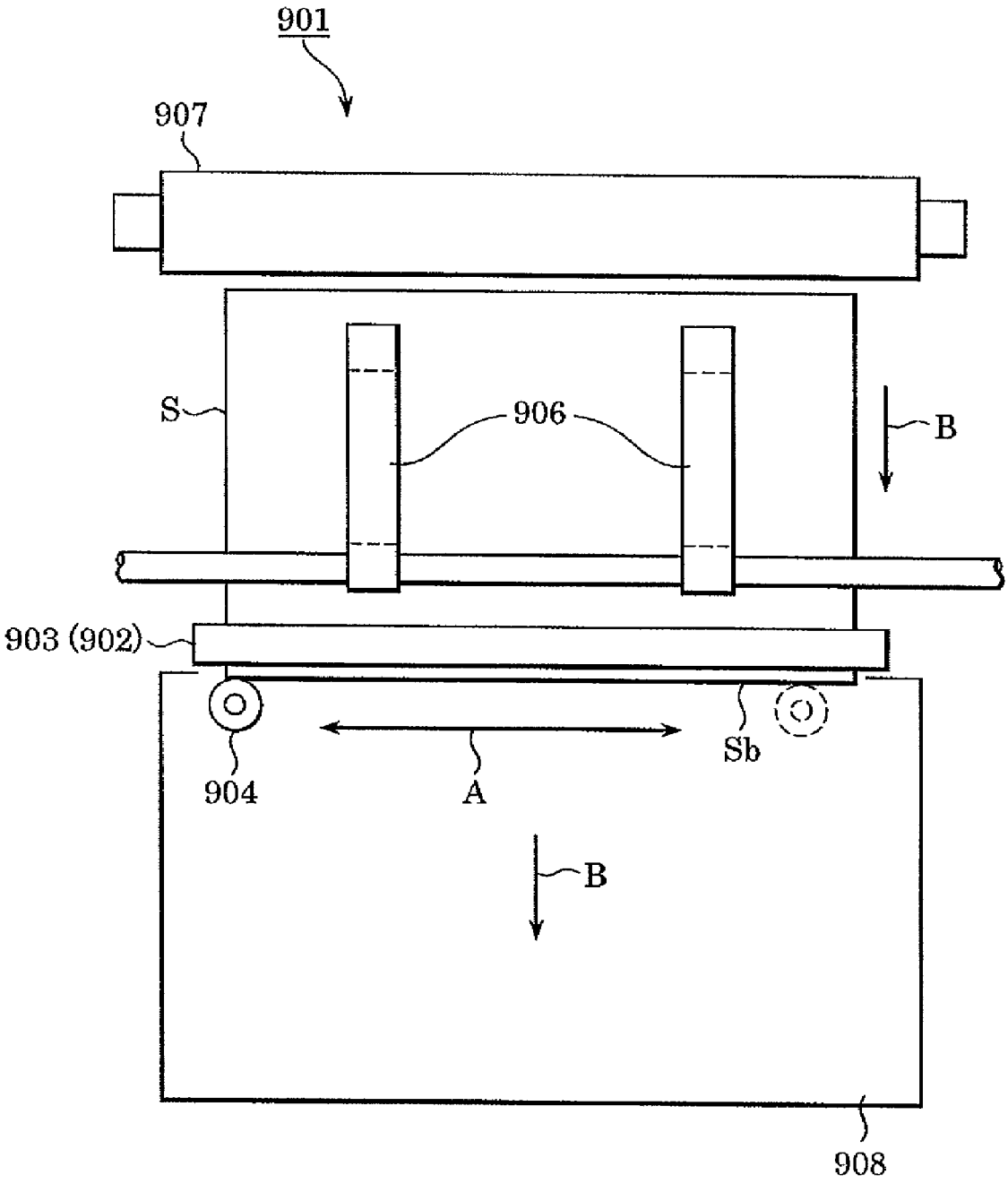
FIG. 15 PRIOR ART
FIG. 15 is a plan view of a known folded back portion flattening device.
Figure 16A:
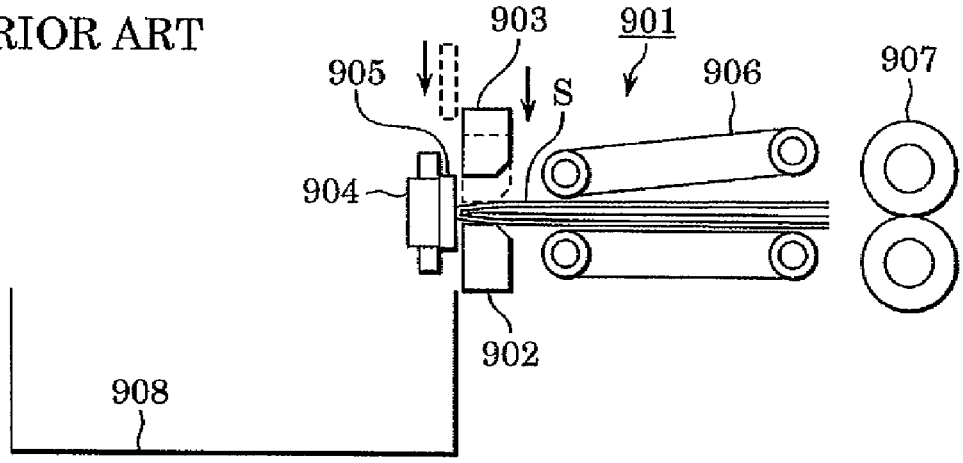
FIG. 16A PRIOR ART
FIGS. 16A to 16C are front views illustrating the operations of the known folded back portion flattening device.
Figure 16B:
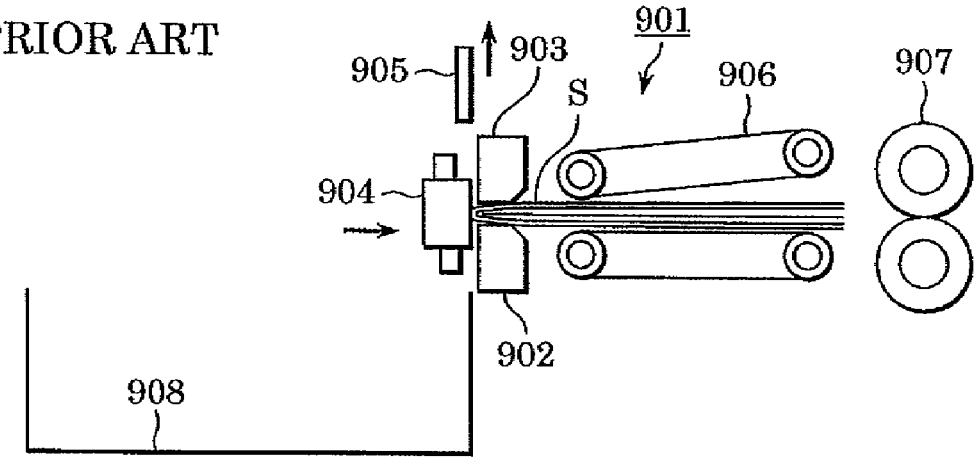
FIG. 16B PRIOR ART
Figure 16C:
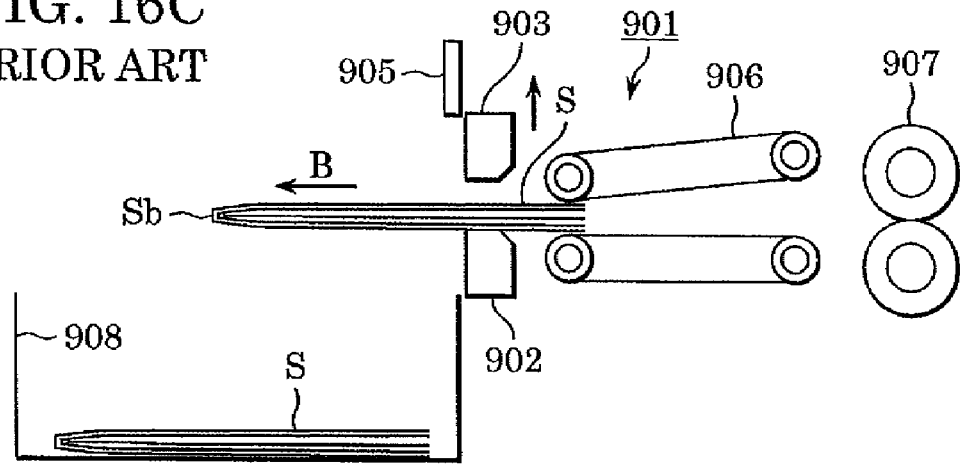
FIG. 16C PRIOR ART
Figure 17:
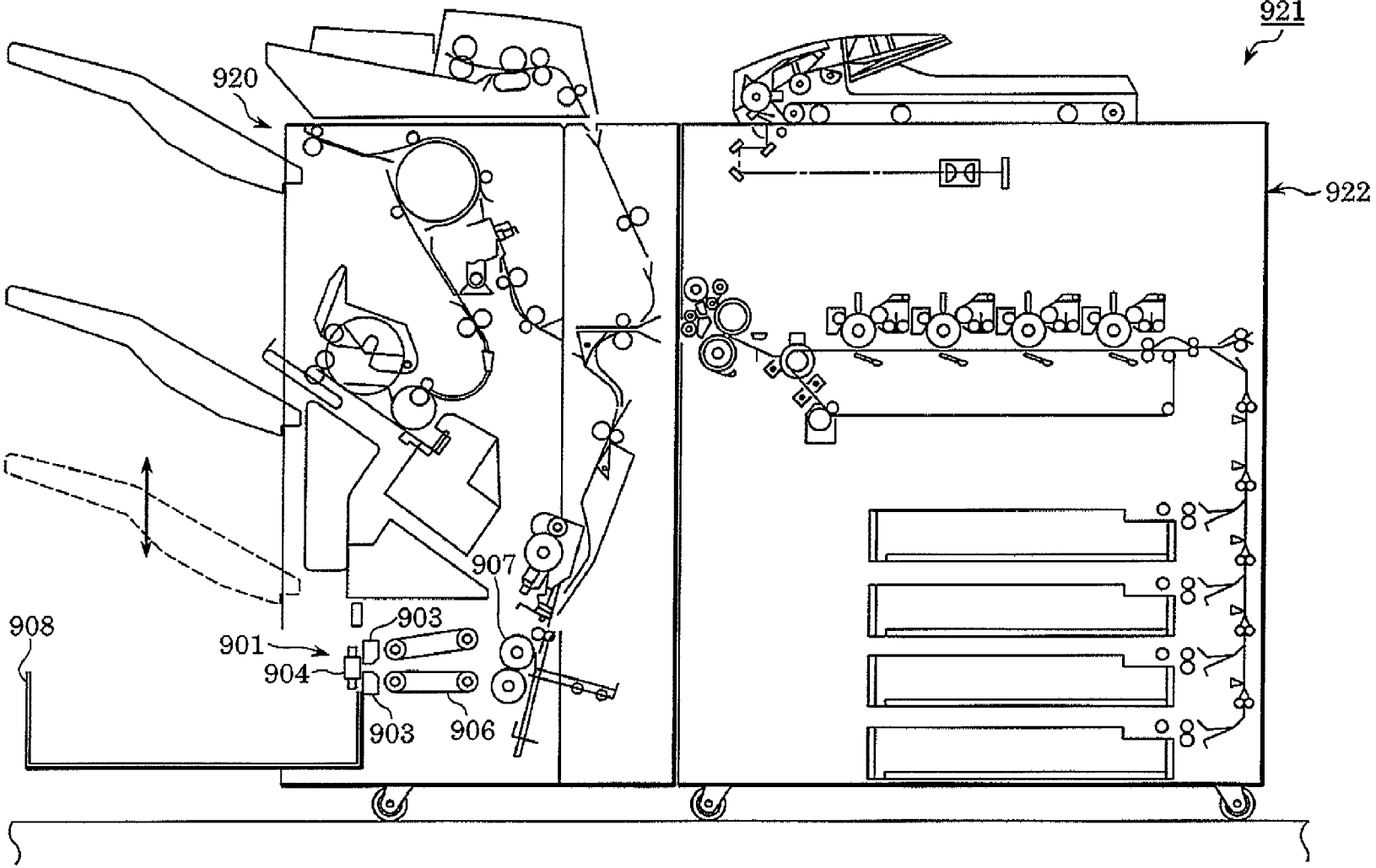
FIG. 17 PRIOR ART
FIG. 17 is a schematic sectional front view of a copying machine incorporating the known folded back portion flattening device.

As described above, in the folded back portion flattening device 141 of the embodiment, the radius of each flange 21 is greater than the radius of each flange 22 by G. Accordingly, the pressing rotational surface 17*a* of the second pressing roller 10 which presses the folded back portion Sb as a result of rotating and moving the flanges 22 along the gripping plates 4 and 5 after the pressing rotational surface 16*a* of the first pressing roller 9 has pressed the folded back portion Sb as a result of rotating and moving the flanges 21 along the gripping plates 4 and 5 presses deeper into the edge of the sheet bundle by the distance G (see FIG. 1). Therefore, when the amount of pressing into the folded back portion by the first pressing roller 9 is small and the sheet bundle is thick or a material which cannot be easily flattened is used when the sheet bundle is not thick, the pressing load can be reduced, so that the folded back portion can be easily flattened. Since the folded back portion is gradually pressed by the first pressing roller 9 and then by the second pressing roller 10, the folded back portion can be easily flattened. Although in the embodiment the radius of each flange 21 is greater than the radius of each flange 22 by G, flanges 421 and 422, serving as restricting members, may have the same radius as long as a pressing rotational surface 417*a* of a second pressing roller 410 presses deeper into the edge of the sheet bundle than a pressing rotational surface 416*a* of a first pressing roller 409 by G as shown in FIGS. 13 and 14.

In the folded back portion flattening device 141 of the embodiment, when the load that is produced when the first pressing roller presses the sheet bundle is reduced, a drive system for moving the first pressing roller 9 and the second pressing roller 10 can be reduced in size, so that the folded back portion flattening device 141 can be reduced in size.

In the folded back portion flattening device 141 of the embodiment, when the folded back portion of the sheet bundle is to be repeatedly pressed a number of times and flattened by the first pressing roller 9 and the second pressing roller 10, the folded back portion is gradually pressed by the first pressing roller 9 and then by the second pressing roller 10, so that the number of times the flattening operation is repeated can be reduced.

In the folded back portion flattening device 141 of the embodiment, since the end stopper 7 receives and stops the folded back portion of the sheet bundle conveyed by the pair of conveying rollers 18 and 19 in order to precisely position the folded back portion, the first pressing roller 9 and the second pressing roller 10 can reliably press the folded back portion. Therefore, the folded back portion can be easily flattened.

In the folded back portion flattening device 141 of the embodiment, since the folded back portion of the sheet bundle is gradually pressed and is flattened by rotating and moving the first pressing roller 9 and the second pressing roller 10, the folded back portion can be flattened without becoming damaged.

Since the sheet processor 2 includes the folded back portion flattening device 141 having an increased efficiency of flattening the folded back portion of the sheet bundle, sheet processing efficiency can be increased by speeding up the folding operation of the folding unit 58.

Since the copying machine 1 includes the folded back portion flattening device 141 having an increased efficiency of flattening the folded back portion of the sheet bundle, the efficiency with which an image is formed on a sheet can be increased.

Folded Back Portion Flattening Device of a Second Embodiment

Figure 8:
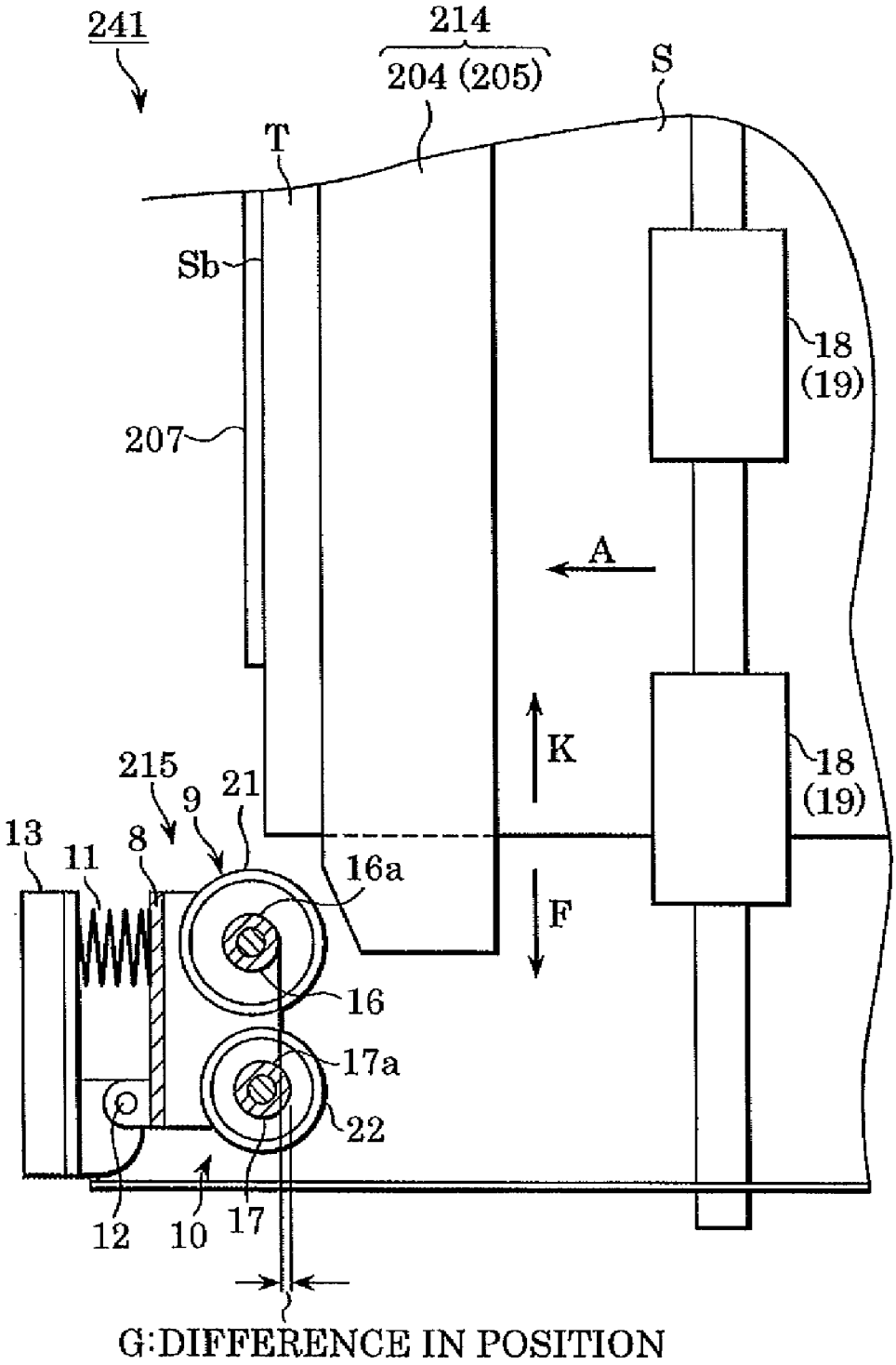
FIG. 8 is a plan view of a folded back portion flattening device of a second embodiment of the present invention.
Figure 9:
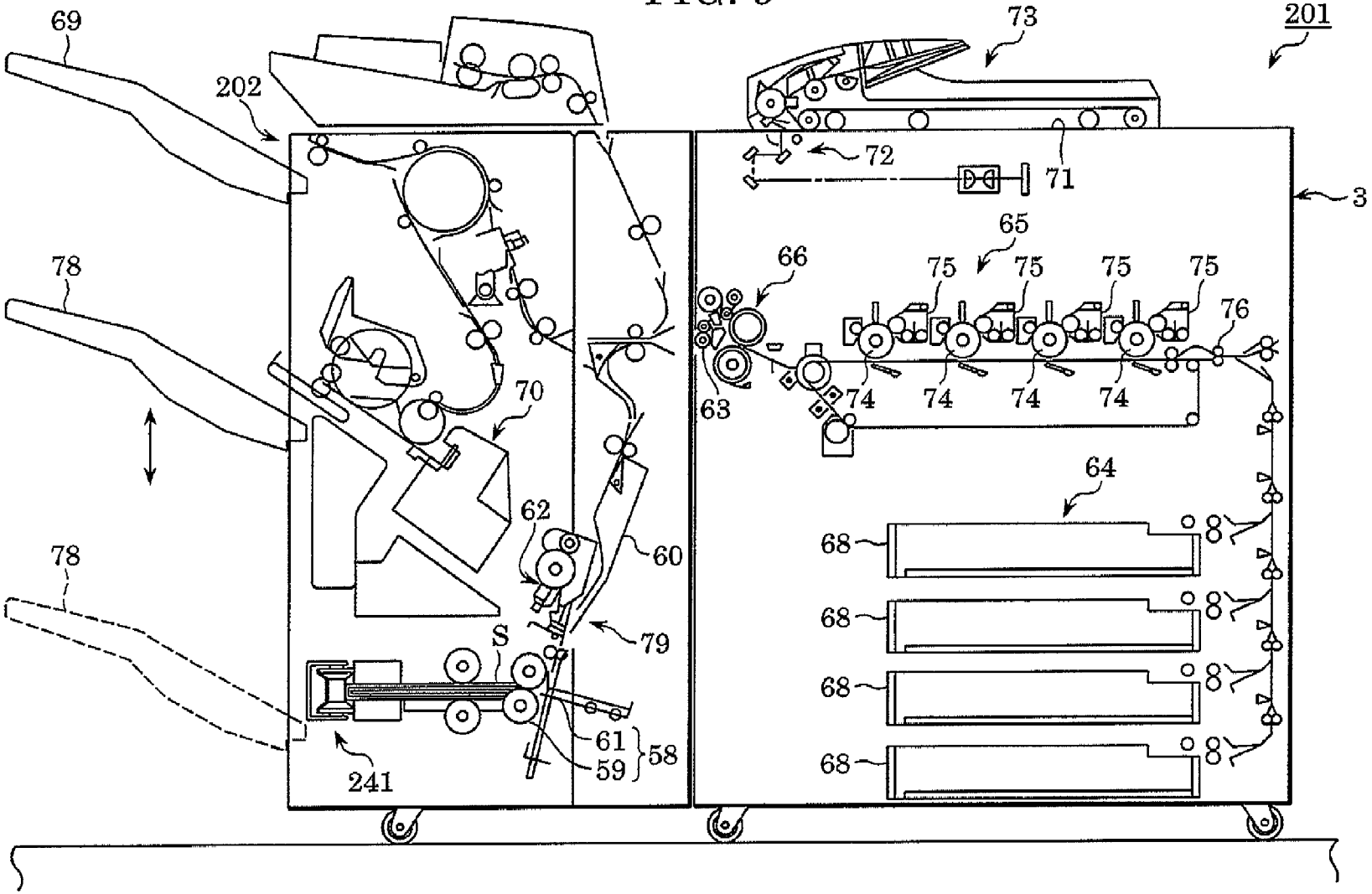
FIG. 9 is a sectional front view of a copying machine incorporating the flattening device of the second embodiment.

Structure of the Folded Back Portion Flattening Device of the Second Embodiment As shown in FIGS. 8 to 10, the folded back portion flattening device 241 of the second embodiment can flatten a curved U-shaped folded back portion (spine) Sb of a sheet bundle S folded in two and formed into a booklet and conveyed from a booklet forming unit 79.

The folded back portion flattening device 241 of the second embodiment includes a gripper 214, a presser 215, and an end stopper 207. The gripper 214 grips the folded sheet bundle. The presser 215 presses and flattens the folded back portion Sb of the sheet bundle S gripped by the gripper 214. The stopper 207 receives and stops the folded back portion Sb of the conveyed sheet bundle S with the folded back portion Sb being a leading end.

In the folded back portion flattening device 241 of the second embodiment, the presser 215 is stationary and fixed, whereas the gripper 214 grips the sheet bundle and moves in the directions of arrows F and K that are perpendicular to the direction of arrow A in which the sheet bundle is conveyed.

Parts corresponding to those of the first embodiment are given the same reference numerals and will not be described below.

Operation of the Folded Back Portion Flattening Device of the Second Embodiment As shown in FIG. 8, the sheet bundle S folded in two by a pair of folding rollers 59 (FIG. 9) is conveyed in the direction of arrow A by pairs of conveying rollers 18 and 19, and the folded back portion Sb contacts the end stopper 207 that has rotated to its upright position, is set so that its slanting orientation is corrected, and is positioned. At this time, the sheet bundle S is disposed between a separated pair of gripping plates 204 and 205. Thereafter, the gripping plate 204 is lowered, so that the gripping plate 204 and the stationary gripping plate 205 grip portions near the folded back portion at both sides of the sheet bundle. The end stopper 207 rotates and retreats from the folded back portion. The end stopper 207 in the embodiment does not necessarily have to rotate and retreat.

Figure 10A:
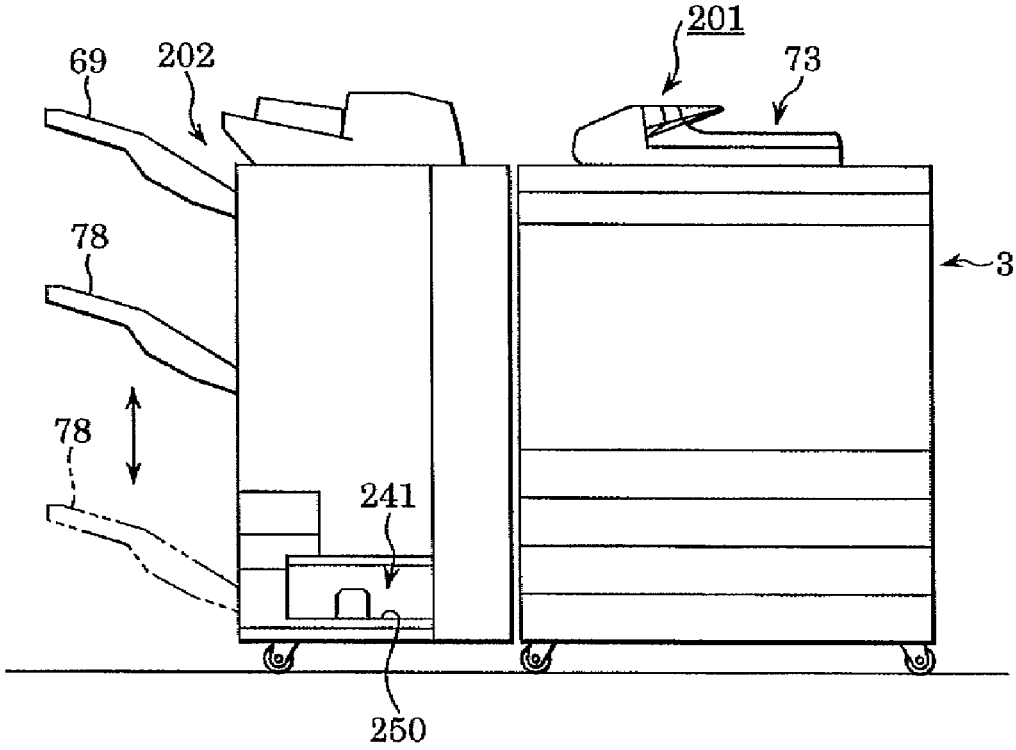
FIG. 10A is an external front view of the copying machine incorporating the folded back portion flattening device of the second embodiment.
Figure 10B:
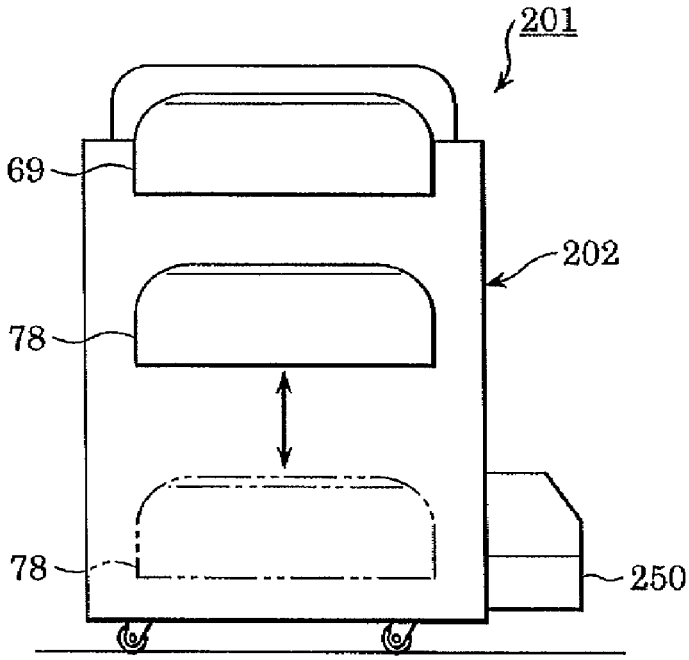
FIG. 10B is a left side view of FIG. 10A.

The pair of gripping plates 204 and 205 gripping the sheet bundle moves in the direction of arrow F (see FIG. 8) that is perpendicular to the direction of conveying of the sheet bundle (that is, the direction of arrow A) by a driving device (not shown), so that the folded portion Sb of the sheet bundle S pushes away a first pressing roller 9 and a second pressing roller 10 of the fixed presser 215 in order to flatten the folded back portion by the first pressing roller 9 and the second pressing roller 10. Lastly, the gripping plates 204 and 205 discharge and load the sheet bundle into a sheet-discharge tray 250 having a portion which protrudes from the front surface of a sheet processor 202 as shown in FIGS. 10A and 10B, which are external views of a copying machine 201. Then, the gripping plates 204 and 205 move in the direction of arrow K in FIG. 8 in order to restore the gripper 214 to its original state.

As described above, in the folded back portion flattening device 241 of the embodiment, the radius of each flange 21 is greater than the radius of each flange 22 by G. Accordingly, a pressing rotational surface 17*a* of the second pressing roller 10 which presses the folded back portion Sb as a result of rotating and moving the flanges 22 along the gripping plates 4 and 5 after a pressing rotational surface 16*a* of the first pressing roller 9 has pressed the folded back portion Sb as a result of rotating and moving the flanges 21 along the gripping plates 4 and 5 presses deeper into an edge of the sheet bundle by the distance G (see FIG. 8). Therefore, when the amount of pressing into the folded back portion by the first pressing roller 9 is small and the sheet bundle is thick or a material which cannot be easily flattened is used when the sheet bundle is not thick, the pressing load can be reduced, so that the folded back portion can be easily flattened. Since the folded back portion is gradually pressed by the first pressing roller 9 and then by the second pressing roller 10, the folded back portion can be easily flattened.

In the folded back portion flattening device 241 of the embodiment, when the load that is produced when the first pressing roller presses the sheet bundle is reduced, a drive system for moving the first pressing roller 9 and the second pressing roller 10 can be reduced in size, so that the folded back portion flattening device 241 can be reduced in size.

In the folded back portion flattening device 241 of the embodiment, when the folded back portion of the sheet bundle is to be repeatedly pressed a number of times and flattened by the first pressing roller 9 and the second pressing roller 10, the folded back portion is gradually pressed by the first pressing roller 9 and then by the second pressing roller 10, so that the number of times the flattening operation is repeated can be reduced.

In the folded back portion flattening device 241 of the embodiment, since, while moving the pair of gripping plates 204 and 205 gripping the sheet bundle in the direction of arrow F (see FIG. 8), the folded back portion is flattened by the first pressing roller 9 and the second pressing roller 10, the conveying of the sheet bundle and the flattening of the folded back portion can be carried out at the same time. Therefore, the folded back portion flattening device 241 of the embodiment can flatten the folded back portion with greater efficiency than the known folded back portion flattening device which flattens the sheet bundle by stopping it. In addition, it is not necessary to increase the distance between bundles of sheets that are conveyed, so that the sheet bundles can be conveyed with greater efficiency.

In the folded back portion flattening device 241 of the embodiment, as shown in FIG. 8, the sheet bundle conveyed in the direction of arrow A is discharged into the sheet-discharge tray 250 by changing the direction of conveying by approximately 90 degrees to the direction of arrow F. Therefore, as shown in FIG. 10, the sheet-discharge tray 250 can be disposed forward of the sheet processor 202 instead of disposing the sheet-discharge tray 250 directly below a stack tray 78, so that the sheet-discharge tray 250 does not interfere with the downward movement of the stack tray 78.

Consequently, the folded back portion flattening device 241 can be disposed below the stack tray 78 at its raised position. This contributes to a size reduction of the sheet processor. In addition, the copying machine 201 and the sheet processor 202 including the folded back portion flattening device 241 of the embodiment make it possible to increase the number of sheets that can be loaded onto the stack tray 78 due to an increase in a range in which the stack tray 78 is raised and lowered. Further, it is not necessary to make the horizontal length of the front side of the copying machine 201 long.

Folded Back Portion Flattening Device of the Third Embodiment

Figure 11:
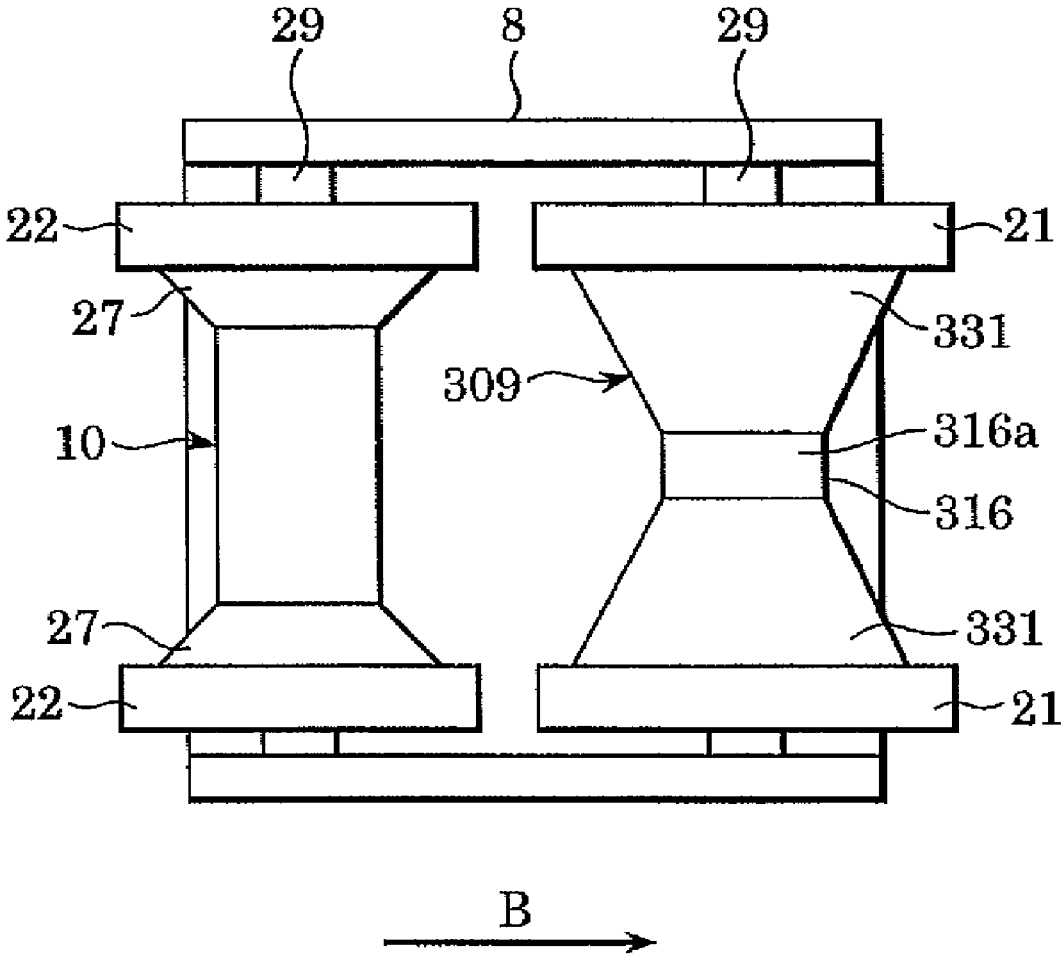
FIG. 11 shows pressing rollers of a folded back portion flattening device of a third embodiment as seen from a sheet bundle.
Figure 12:
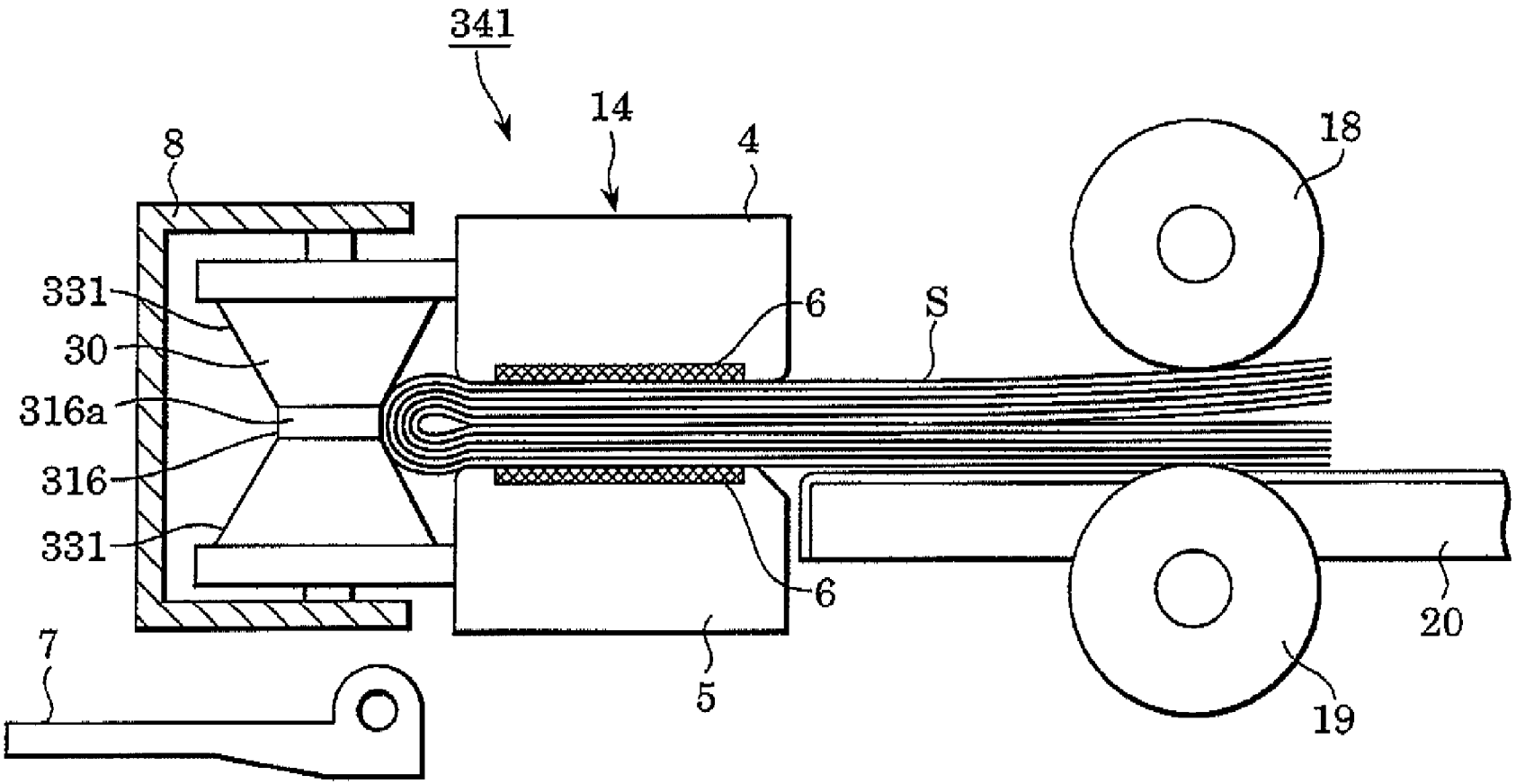
FIG. 12 is a partial front view of the folded back portion flattening device of the third embodiment when a folded back portion of the sheet bundle is being flattened by the pressing rollers.

Structure of the Folded Back Portion Flattening Device of the Third Embodiment As shown in FIGS. 11 and 12, a folded back portion flattening device 341 of the third embodiment is constructed by providing the first pressing rollers 9 of the folded back portion flattening devices 141 and 241 of the first and second embodiments with the function of guiding a folded back portion of a sheet bundle. Parts of the folded back portion flattening device 341 corresponding to those of the folded back portion flattening device 141 of the first embodiment are given the same reference numerals and will not be described below.

FIG. 11 shows a first pressing roller 309 and a second pressing roller 10 of the folded back portion flattening device 341 as seen from the folded back portion of the sheet bundle. Tapering portions 331, which serve as guide surfaces, are formed on and under (in FIG. 11) a pressing roller portion 316 having a pressing rotational surface 316*a* of the first pressing roller 309. As shown in FIG. 12, the tapering portions 331 guide the folded back portion of the sheet bundle to the pressing rotational surface 316*a*, and can reduce vertical tilting (in FIG. 11) of the folded back portion.

Although the pressing roller portion 316 has the form of a straight shaft, the pressing rotational surface 316*a* and the tapering portions 331 and 331 may be curved to provide the same advantage.

Although in the folded back portion flattening devices 141 and 241 of the first and second embodiments either one of the gripper 14 and the presser 15 and either one of the gripper 214 and the presser 215 are movable, both of them may be movable.

The two pressing rollers may be disposed as shown in FIGS. 13 and 14 in order to dispose a pressing rotational surface of a pressing roller which presses the folded back portion after a pressing rotational surface of another pressing roller has pressed the folded back portion and which presses deeper into an edge of the sheet bundle than the pressing rotational surface of the another pressing roller. In other words, a pressing rotational surface 417*a* of a second pressing roller 410 which presses the folded back portion after a pressing rotational surface 416*a* of a first pressing roller 409 has pressed the folded back portion may press deeper into the edge of the sheet bundle by a distance G than the pressing rotational surface 146*a* of the first pressing roller 409, when shafts 428 and 429 serving as rotational centers of the pressing rollers 409 and 410 are disposed parallel to the folded back portion of the sheet bundle, and a diameter (D3) of a pressing roller portion 417 of the second pressing roller 410 is greater than a diameter (D2) of a pressing roller portion 416 of the first pressing roller 409, that is, D3>D2. In this case, since the diameter of the pressing roller portion 417 is larger, the folded back portion can be easily finished to have a smooth flat surface. Parts shown in FIGS. 13 and 14 that correspond to those shown in FIGS. 1 and 6 are given the same reference numerals.

The number of pressing rollers is not limited to two. Therefore, three or more pressing rollers may be provided, in which case the pressing rollers are such their pressing amounts into the edge of the sheet bundle are progressively larger.

Although the pressing rollers 9, 10, 309, 409, and 410 are described as examples of pressing members which press the folded back portion, any members, such as rotatable belts, spatula-shaped members, or arc members, may be used as long as the members can press the folded back portion of the sheet bundle. These members must be disposed so that the pressing surface of any member which presses the folded back portion after the pressing surface of another member has pressed the folded back portion presses deeper into the edge of the sheet bundle.

Although, in the folded back portion flattening device of each of the embodiments, the folded back portion of the sheet bundle saddle bound by the stapler 62 is flattened, a folded back portion which is perfect bound can similarly be flattened.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-055558 filed Feb. 27, 2004 and Japanese Patent Application No. 2005-001626 filed Jan. 6, 2005, which are hereby incorporated by reference herein.

What is claimed is:

1. A sheet processor operable to process sheets, comprising:

a folding unit configured to bundle the sheets and to fold the sheet bundle; and a folded back portion flattening device including:

a gripping unit configured to grip the sheet bundle such that the folded back portion of the sheet bundle protrudes from the gripping unit; and a pressing unit configured to press the folded back portion of the sheet bundle gripped by the gripping unit, wherein the gripping unit and the pressing unit are relatively movable, wherein the pressing unit includes first and second pressing members arranged such that the first pressing member presses the folded back portion prior to the second pressing member pressing the folded back portion, wherein each of the first and the second pressing members has a pressing surface adapted to press the folded back portion, and wherein the pressing surface of the second pressing member presses deeper into the folded back portion than the pressing surface of the first pressing member pressing into the folded back portion.

2. The sheet processor according to claim 1, wherein the folded back flattening device comprises:

a stopping member stopping the folded back portion of the sheet bundle conveyed from the folding unit with the folded back portion being a leading end, so as to allow the gripping unit to grip the sheet bundle so that the folded back portion protrudes from the gripping unit, wherein the first and second pressing members move along the folded back portion.

3. The sheet processor according to claim 1, wherein the folded back flattening device comprises:

a stopping member stopping the folded back portion of the sheet bundle conveyed from the folding unit with the folded back portion being a leading end, so as to allow the gripping unit to grip the sheet bundle so that the folded back portion protrudes from the gripping unit, wherein the gripping unit moves along the folded back portion in order to press the folded back portion of the sheet bundle by the first and second pressing members.

4. The sheet processor according to claim 1, wherein the first and second pressing members includes at least first and second rotary members.

5. The sheet processor according to claim 4, wherein the gripping unit includes a guide surface along the folded back portion, and wherein each rotary member includes a restricting portion rotatably movable to contact the guide surface.

6. The sheet processor according to claim 5, wherein the rotary members include at least first and second rollers, the first and second rollers having circumferential pressing surfaces with substantially the same diameters, and wherein the restricting portions perform a restricting operation so that the circumferential pressing surface of the second roller, which presses the folded back portion after the circumferential pressing surface of the first roller has pressed the folded back portion, presses deeper into the sheet bundle than the circumferential pressing surface of the first roller.

7. The sheet processor according to claim 6, wherein a diameter of the restricting portion of the first roller is larger than a diameter of the restricting portion of the second roller.

8. The sheet processor according to claim 5, wherein the rotary members include rollers, including at least first and second rollers having circumferential pressing surfaces, wherein the restricting portions perform a restricting operation so that lines passing through rotational centers of the first and second rollers are disposed along the folded back portion, and wherein a diameter of the circumferential pressing surface of the second roller, which presses the folded back portion after the circumferential pressing surface of the first roller has pressed the folded back portion, is larger than a diameter of the pressing surface of the first roller.

9. The sheet processor according to claim 5, wherein each rotary member includes a folded back portion guide surface defined between the circumferential pressing surface and the restriction portion and configured to guide the folded back portion to the circumferential pressing surface.

10. An image forming apparatus operable to form images on sheets, comprising:

an image forming unit configured to form images on the sheets;

a folding unit configured to bundle the sheets having the images formed thereon by the image forming unit and to fold the sheet bundle; and a folded back portion flattening device including:

a gripping unit configured to grip the sheet bundle such that the folded back portion of the sheet bundle protrudes from the gripping unit; and a pressing unit configured to press the folded back portion of the sheet bundle gripped by the gripping unit, wherein the gripping unit and the pressing unit are relatively movable, wherein the pressing unit includes first and second pressing members arranged such that the first pressing member presses the folded back portion prior to the second pressing member pressing the folded back portion, wherein each of the first and the second pressing members has a pressing surface adapted to press the folded back portion, and wherein the pressing surface of the second pressing member presses deeper into the folded back portion than the pressing surface of the first pressing member pressing into the folded back portion.

* * * * *